US006536307B1

(12) United States Patent
Neri et al.

(10) Patent No.: US 6,536,307 B1
(45) Date of Patent: Mar. 25, 2003

(54) DEVICE FOR OPERATING A CASHBOX CLOSURE MECHANISM

(75) Inventors: Armando Neri, Bologna (IT); Paul Gray, Garland, TX (US)

(73) Assignee: Currency Systems International, Irving, TX (US)

( * ) Notice: Subject to any disclaimer, the term of this patent is extended or adjusted under 35 U.S.C. 154(b) by 106 days.

(21) Appl. No.: 09/784,010

(22) Filed: Feb. 16, 2001

(30) Foreign Application Priority Data

Feb. 21, 2000 (IT) ..... BO2000A74

(51) Int. Cl.[7] ..... B25B 33/00
(52) U.S. Cl. ..... 81/15.9; 81/484; 29/804
(58) Field of Search ..... 81/15.9, 484; 29/804

(56) References Cited

U.S. PATENT DOCUMENTS 1,599,901 A * 9/1926 Kwiecinski ..... 70/80
2,507,981 A * 5/1950 Krause ..... 81/15.9
3,580,167 A * 5/1971 Simshauser ..... 100/218
4,529,119 A * 7/1985 Granzow et al. ..... 109/43
4,597,340 A * 7/1986 Huckle ..... 109/45
4,895,008 A * 1/1990 Blake ..... 109/47
5,533,605 A 7/1996 Mays et al.
5,641,157 A 6/1997 Mays et al.
5,655,763 A 8/1997 Gerlier
5,715,923 A * 2/1998 Dekker et al. ..... 194/206
5,937,713 A * 8/1999 Walters ..... 81/15.9
6,126,210 A * 10/2000 Tom ..... 292/119

* cited by examiner

*Primary Examiner*—Joseph J. Hail, III
*Assistant Examiner*—Hadi Shakeri
(74) *Attorney, Agent, or Firm*—Colin P. Cahoon; Carstens, Yee & Cahoon

(57) ABSTRACT

Boxes containing banknotes are secured by a mechanism utilizing a latch plate that can be removed and replaced automatically by a device of which the parts include a top slide equipped with a pivoting arm and a pusher designed to hold the latch plate steady and in tension from two points of contact; the device is also equipped with a bottom slide carrying a gripper of which the two jaws operate in concert one with another and with the pusher and the arm to release the latch plate from the position in which it secures the box.

14 Claims, 7 Drawing Sheets

1
2
3
3a
4
5
6
7
8
9
10
11
12a
12b
13
14
14a
16
17
18
19
20
21
22
24
25
25a
26
26a
27
28
29
30
31
32
32a
32b
33
33a
33b
34
35
36
37
38
43
44
45
46
46a
47
48
52
53
55
56
57
58
59
60
61
62
65
A 1
2
3
3a
4
5
6
7
8
10
12
12a
12b
13
13b
14
15
18
19
20
21
22
23
24
25
25a
26
26a
27
28
29
30
31
32
32a
32b
33
33a
34
35
37
39
43
44
45
46
46b
50
51
53
56
57
58
61
63
64
65

DEVICE FOR OPERATING A CASHBOX CLOSURE MECHANISM

BACKGROUND OF THE INVENTION

The present invention relates to a device for operating a cashbox closure mechanism.

In particular, the invention relates to a device for the operation of a closure mechanism used to secure boxes containing groups of sheets, typically banknotes.

The invention finds application to advantage in machines for processing banknotes, the art field to which explicit reference is made in the following specification albeit implying no limitation in general scope.

It is well known that banks need to move notable amounts of paper money around on a daily basis, whether central banks by which new banknotes are issued, or trading banks through which the notes are circulated. To this end, banknotes are first sorted into groups and then, for the purposes of transport, put into boxes.

The boxes are of a conventional type consisting in a container, and a lid hinged either permanently or detachably to the container.

To ensure they can be transported without any risk of coming open accidentally, such boxes are provided with a positive or catch type closure mechanism.

Likewise by reason of the need to move notable quantities of banknotes around on a daily basis, the machines by which notes are checked, bundled and strapped have been improved over the years and rendered capable of processing the quantities in question at extremely high speed.

One drawback encountered in banknote processing machines of the type in question is attributable to the operations connected with opening and closing the boxes at the outfeed stations by way of which the groups of notes emerge, for example, from the strapper/bander. In effect, these operations have been performed hitherto by hand.

The drawback in question is the more noticeable when, as happens more and more frequently, boxes are directed at a particularly rapid rate to the outfeed stations from which the groups of banknotes emerge, so that any operation performed by hand will risk occasioning a sizeable reduction in the output capacity normally expected from the overall processing cycle.

The object of the present invention is to provide a device for operating the closure mechanism of a box containing groups of banknotes, such as will be capable of opening and closing the box with speed and precision while assuring a highly dependable end result.

SUMMARY OF THE INVENTION

The stated object is realized according to the invention in a device for operating the closure mechanism of a box containing groups of sheets, in particular banknotes, wherein the box comprises a container and a lid fastenable in the position by which the container is secured through the agency of a closure mechanism including at least one latch element by which a portion of the lid is connected to a retaining and locking element integral with the container and combining with the latch element to create a catch mechanism, characterized in that it comprises means of releasing the latch element, by which the selfsame latch element is disengaged at least in part from the container and from the lid; and restraining means acting on the latch element in such a way as to distance the selfsame latch element from the lid.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
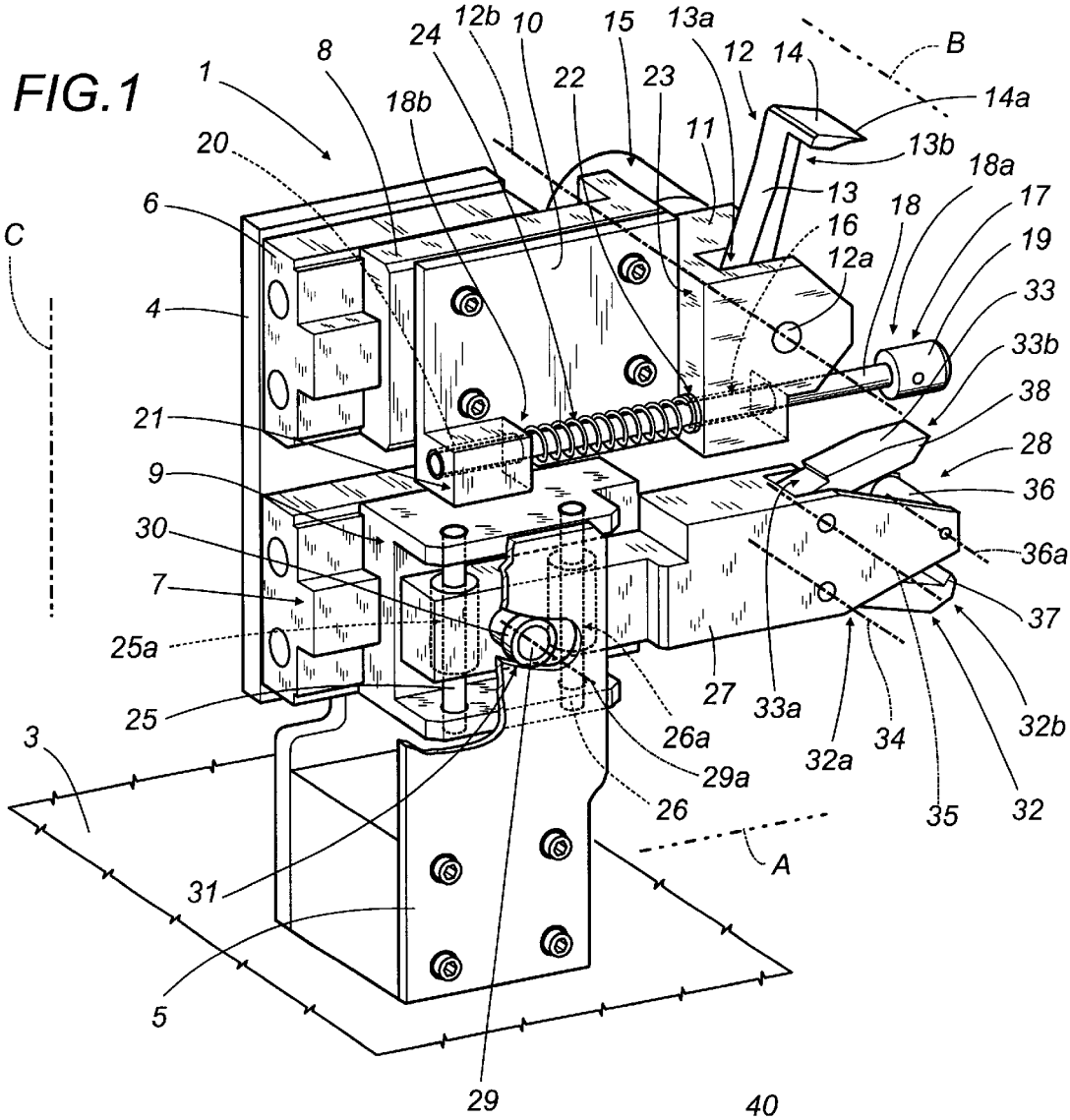
FIG. 1 illustrates a preferred embodiment of the operating device according to the invention, viewed in perspective from above and with certain parts omitted for clarity.
Figure 2:
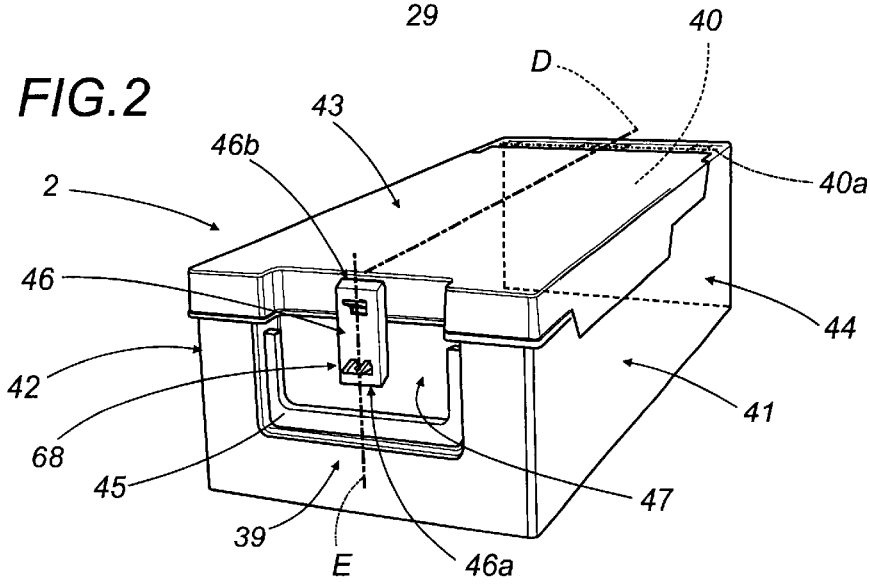
FIG. 2 illustrates a box for banknotes, viewed in perspective from above.

With reference to FIG. 1 of the accompanying drawings, 1 denotes a device, in its entirety, for opening and closing a box 2 of the type shown in FIG. 2 serving to contain groups of sheets, in particular banknotes.

The device 1 comprises a frame 3 supporting two vertical and mutually parallel side walls 4 and 5. One side wall 4 carries a first slide way 6 and a second slide way 7, top and bottom respectively in relation to the frame 3, disposed parallel one with another and extending longitudinally in a first direction denoted A. Mounted slidably to the ways 6 and 7 are a top first slide 8 and a bottom second slide 9. The bottom slide 9 is interposed between the relative way 7 and the side wall denoted 5.

As illustrated in FIGS. 4 to 8, the frame 3 affords a housing 3*a,* to the right of the ways 6 and 7 as viewed in the selfsame drawings, serving to accommodate a box 2.

Still observing FIG. 1, the top first slide 8 carries a plate 10 parallel to the side wall 4, and a mounting 11 integral with an end of the slide 8 directed toward the aforementioned housing 3*a* by which the box 2 is accommodated.

The mounting 11 carries a restraining element 12, supported by a pivot 12*a* of which the axis 12*b* extends in a horizontal direction B at right angles to the aforementioned longitudinal direction A, consisting in an arm 13 integral with the pivot 12*a* and furnished at the free end with an adze-like blade 14 of which the free edge 14*a* is disposed parallel to the horizontal direction B.

The pivot 12*a* is coupled to an electric motor 15 associated with the mounting 11 in such a way that the arm 13 can be made to rotate about the axis 12*b* of the selfsame pivot 12*a*.

The mounting 11 also affords a first cylindrical opening 16 consisting in a through hole centered on an axis parallel to the longitudinal direction A.

A second cylindrical opening 20 disposed coaxial with the first cylindrical opening 16 is afforded by a boss 21 integral with the plate 10, placed to the left of the mounting 11 as viewed in FIG. 1.

The two cylindrical openings 16 and 20 constitute means by which to support and guide a pusher 17 comprising a rod 18, accommodated slidably by the selfsame openings 16 and 20, and a button 19 fitted to a free end of the rod 18 directed toward the housing 3*a* that accommodates the box 2.

The rod 18 presents an annular stop collar 22 positioned between the two cylindrical openings 16 and 20 in such a way as to locate against a face 23 of the mounting 11 directed toward the boss 21.

The rod 18 is also ensheathed by a coil spring 24 positioned between the boss 21 and the annular stop collar 22.

The second slide 9 carries two rods 25 and 26 of which the axes occupy a common plane and extend parallel to a third direction denoted C, orthogonal to the two directions A and B mentioned previously.

The two rods 25 and 26 are coupled slidably with relative cylindrical openings 25*a* and 26*a* afforded by the body 27 of a gripper 28.

The gripper body 27 extends in the aforementioned longitudinal direction A and is disposed with the components of the gripper 28, to be described in due course, directed toward the housing 3*a* occupied by the box 2.

A pivot 29 located at an intermediate point on the body 27 between the two openings 25*a* and 26*a,* with its axis disposed parallel to the horizontal direction B, carries a freely revolving roller 30 positioned so as to engage a cam 31 afforded by the corresponding side wall 5.

More exactly, the cam 31 consists in a slot of arcuate geometry, sloping downwards from left to right as viewed in the drawings.

The gripper 28 comprises a pair of jaws 32 and 33, upper and lower respectively when considered in relation to the frame 3. The jaws 32 and 33 are hinged by way of respective ends 32*a* and 33*a* to the body 27 and pivotable thus about respective axes 34 and 35 disposed parallel one with another and with the aforementioned second direction B.

The end of the body 27 longitudinally remote from the rods 25 and 26, directed toward the housing 3*a* that accommodates the box 2, is furnished with a roller 36 interposed between the two jaws 32 and 33 and rotatable freely about an axis 36*a* parallel to the pivot axes 34 and 35 of the jaws.

The free end 32*b* of the lower jaw 32 presents a lip 37 directed toward the roller 36.

The free end 33*b* of the upper jaw 33 presents a tip 38 of tapered profile.

The movements of the two jaws 32 and 33 and those of the top slide 8 and bottom slide 9 are generated by respective pneumatic actuators of conventional embodiment not illustrated in the drawings.

As illustrated in FIG. 2, the cashbox 2 is of substantially elongated parallelepiped appearance, viewed in a longitudinal direction D coinciding substantially with a stacking axis (not indicated) on which the banknotes (likewise not indicated) are aligned internally of the box 2.

In the closed configuration (see FIG. 2), the box 2 presents a front face 39 and a rear face 40, disposed parallel one with another and normal to the longitudinal direction D, and two side faces 41 and 42 parallel to the longitudinal direction D.

The box 2 comprises a lid 43 positioned over an open topped container 44, with which the selfsame lid 43 is associated pivotably and removably along a hinge 40*a* adjacent to the rear face 40. The front face 39 of the box 2 also presents a handle 45 and a latch element 46 by which the lid 43 is secured to the container 44.

The front face 39 presents a recessed portion 47 serving to accommodate the handle 45 and the latch element 46, so that these parts remain within the parallelepiped compass of the box 2.

Figure 3:
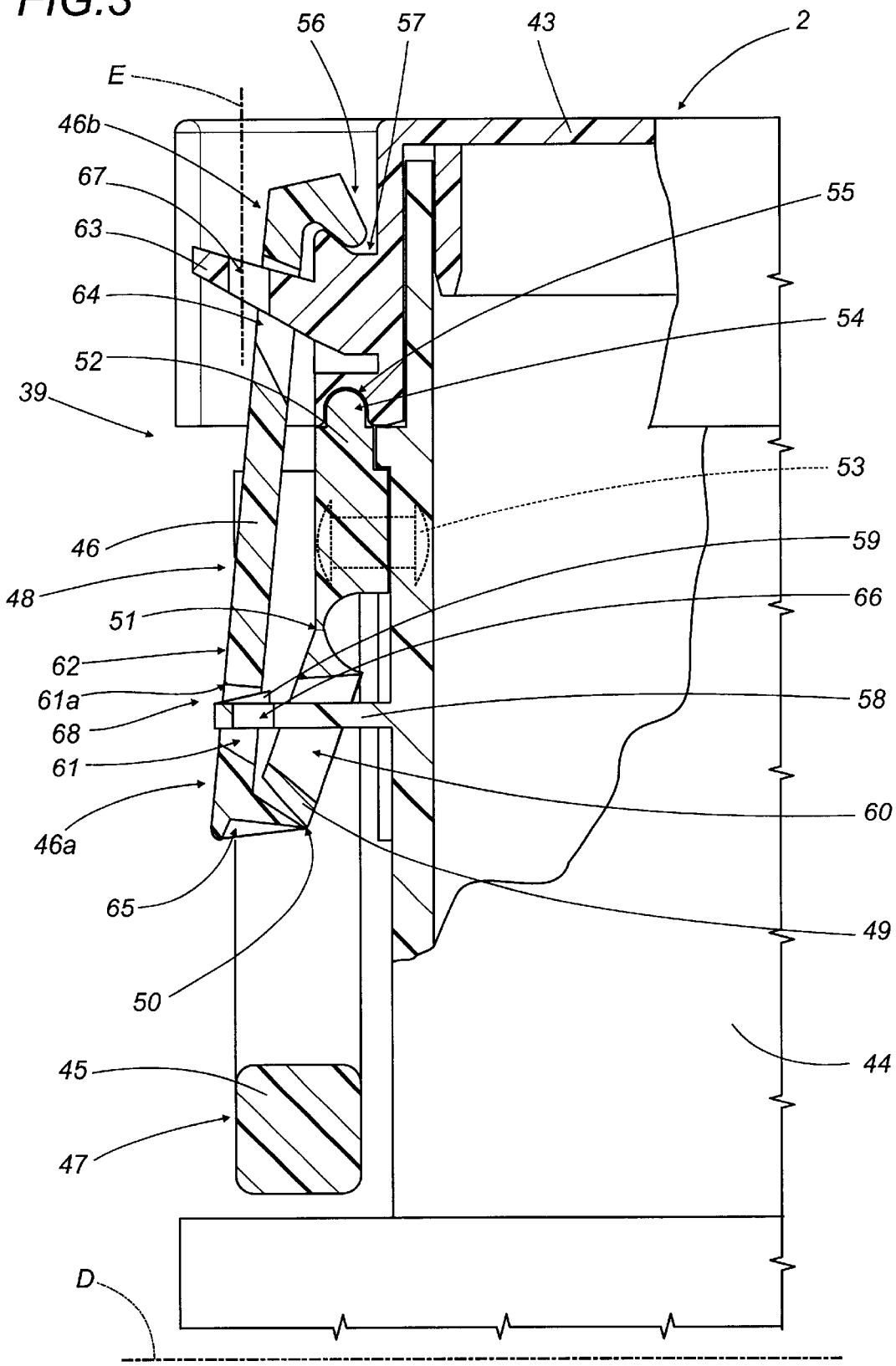
FIG. 3 shows a portion of the box in FIG. 2, enlarged and in a side elevation.

As illustrated in FIG. 3, the latch element 46 forms part of an articulated closure mechanism 48 with which the box 2 is furnished. The mechanism 48 comprises a movable lever 49 connecting by way of a first hinge 50 with a bottom end 46*a* of the latch element 46 and by way of a second hinge 51 with a fixed arm 52 anchored to the container 44 by means of conventional fastening elements 53.

At the end opposite the second hinge 51, the fixed arm 52 exhibits a portion 54 of semicircular profile designed to locate in a relative cavity 55 afforded by the lid 43, shaped so as to ensure the correct relative positioning of the lid 43 and the container 44.

The latch element 46 presents a tooth 56 at the top end 46*b,* remote from the aforementioned bottom end 46*a,* designed to engage in a relative concave seat 57 afforded by the lid 43.

Associated with the front face 39 of the box 2, the container 44 presents a projecting flexible member 58 of which the free end affords a tooth 59. The lever 49 and the bottom end 46*a* of the latch element 46 are fashioned with respective slots 60 and 61 positioned so as to align one with another when the latch element 46 assumes the position in which the box 2 is closed, thereby admitting the projecting flexible member 58 and enabling the relative tooth 59 to snap over a corner edge 61*a* along which the slot 61 meets an outwardly directed surface 62 of the latch element 46.

The snap type closure thus described constitutes a catch mechanism denoted 68 in its entirety.

Likewise on the front face 39 of the box 2, the lid 43 presents a projecting rigid member 63 placed below the concave seat 57 and insertable through a relative slot 64 afforded by the latch element 46 near the top end 46*b*.

The bottom end 46*a* of the latch element 46 is fashioned with a recess 65 such as can be engaged, in a manner shortly to be described in more detail, by the aforementioned lip 37 on the lower jaw 32 of the gripper 28.

The two projecting members 58 and 63 are embodied with respective through holes 66 and 67 aligned one with another on an axis E extending substantially transverse to the longitudinal direction D, so that the box 2 can be secured with a conventional seal (not illustrated) if needed.

Figure 4:
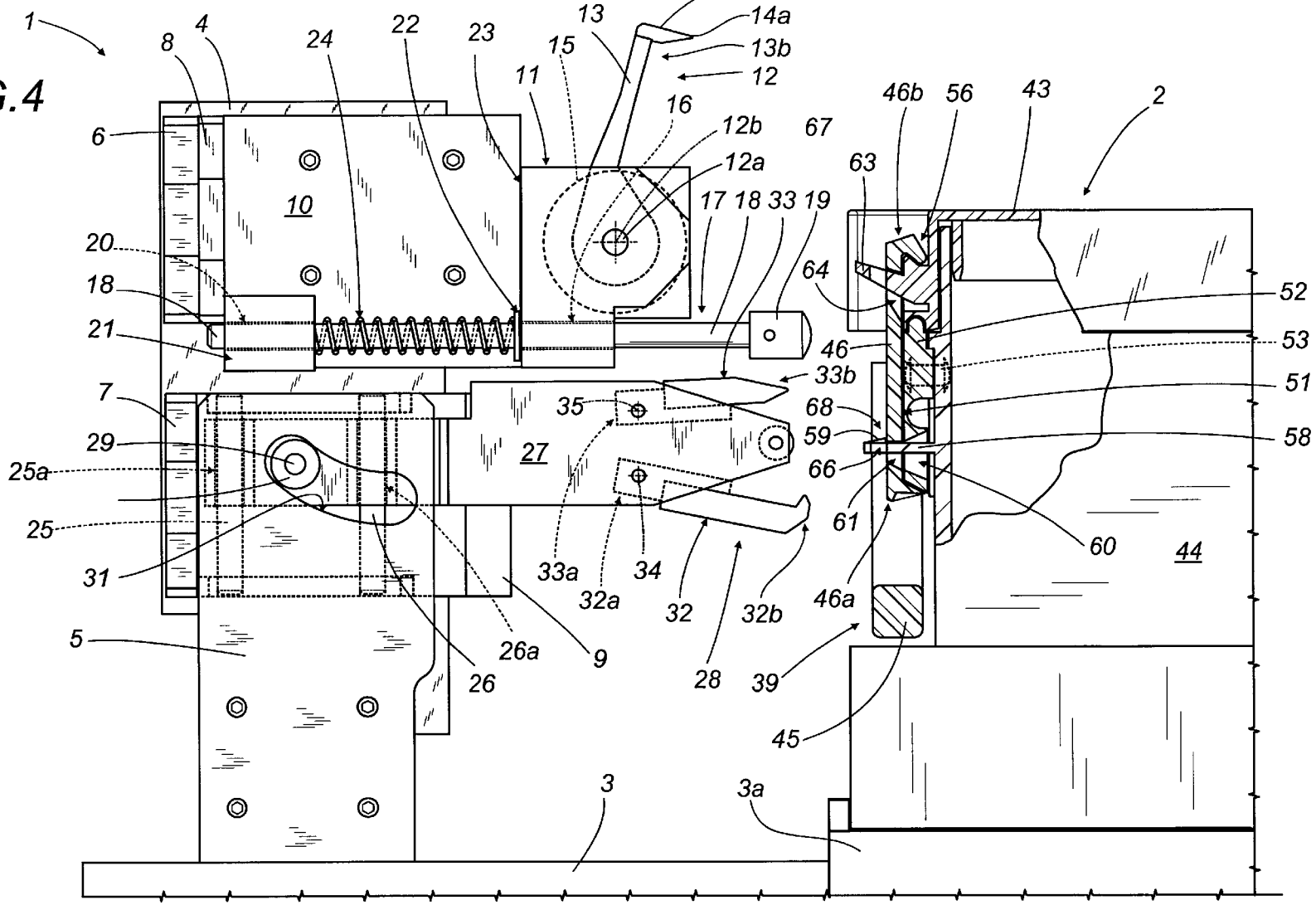
FIGS. 4, 5, 6, 7 and 8 are respective schematic side elevations illustrating the device of FIG. 1 in a succession of operating steps.

In operation, referring to FIG. 4, the device 1 is disposed initially in an at-rest position facing the box 2, which will have been positioned in the housing 3*a* by manipulating devices of conventional embodiment (not illustrated). In this situation the box 2 is disposed with the front face 39 directed toward the working parts of the device 1 by which the closure mechanism is released and secured.

In the configuration described, the two slides 8 and 9 assume respective retracted positions, both distanced from the front face 39 of the box 2. In particular, the pusher 17 makes no contact with the latch element 46, the arm 13 occupies the raised position, the jaws 32 and 33 of the gripper 28 are spread and the pivot 29 occupies its leftward-most limit position in the slot of the cam 31, as viewed in FIG. 4.

Figure 5:
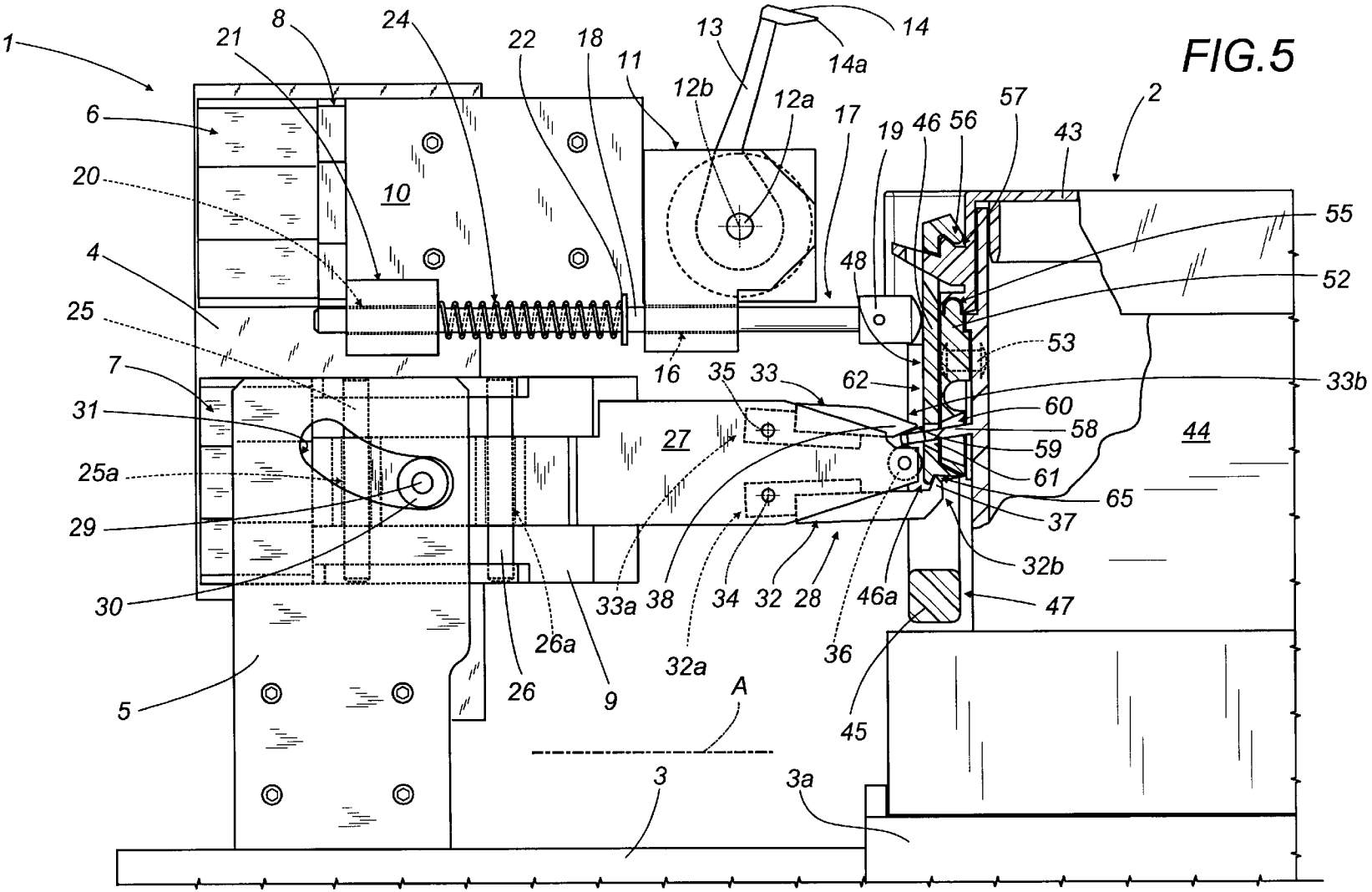

FIG. 5 illustrates a first operating step in which the slides 8 and 9 of the device 1 are both caused to advance from the at-rest positions of FIG. 4 through the agency of the aforementioned pneumatic actuators (not illustrated), moving along the respective ways 6 and 7 in the aforementioned longitudinal direction A and toward the box 2. In this first operating configuration, the button 19 of the pusher 17 is positioned in contact with the latch element 46 at an intermediate point along its length. As a result of the advancing movement, the coil spring 24 is compressed partially.

In the lower section of the device, the slide 9 is caused to move forward and the body 27 of the gripper 28 made simultaneously to dip as the result of its interaction with the profile of the cam 31, bringing the body 27 to a stop in contact with the bottom end 46*a* of the latch element 46. The moment of contact occurs when the roller 36 strikes the outer surface 62 of the latch element 46.

As the roller 36 locates against the surface 62, the gripper 27 is closed through the agency of the aforementioned pneumatic actuators (not indicated).

As a result of this closing movement the tapered tip 38 of the upper jaw 33 engages the flexible member 58, which is made to flex downwards and thus release the tooth 59 of the selfsame member 58 from its position of positive engagement with the corner edge 61*a*.

At the same time, the lip 37 of the lower jaw 32 engages the recess 65 in the bottom end 46*a* of the latch element 46.

Figure 6:
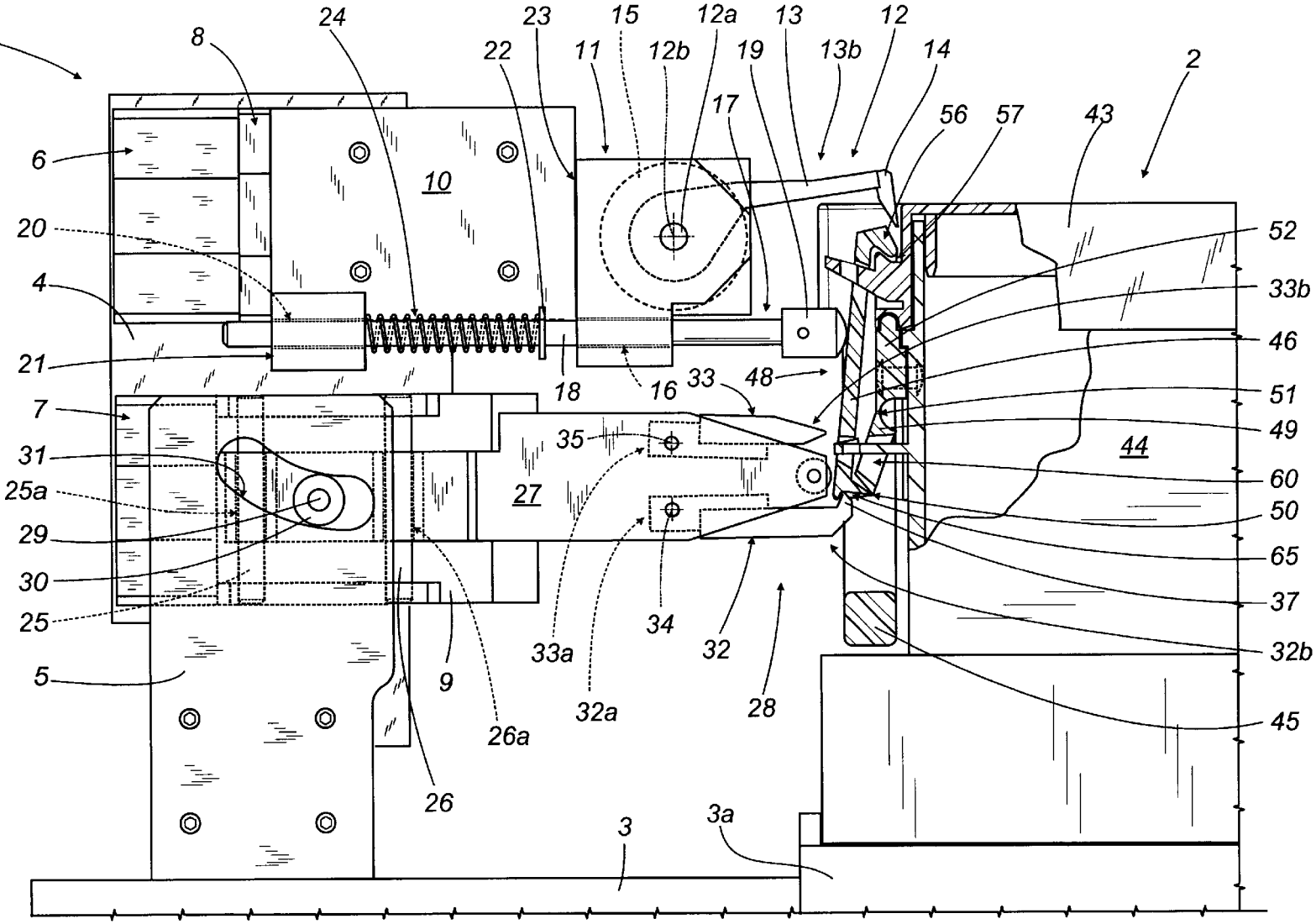

Referring next to FIG. 6, the bottom slide 9 begins to draw back along the relative bottom way 7 with the result that the body 27 is distanced a short space from the box 2 and lifted at the same time by the profile of the cam 31. The lip 37 of the lower jaw 32, being rigidly associated with the body 27, now retracts and lifts likewise and drags with it both the latch element 46, with which it is engaged directly, and the lever 49 hinged to the latch element 46. The lever 49 is thus caused to rotate clockwise, as viewed in FIG. 6, about the hinge 51 by way of which it is associated with the fixed arm 52 of the box closure mechanism 48.

During this same step, the top slide 8 remains motionless relative to the way 6, and as a result of the movement described by the latch element 46, identifiable initially to all intents and purposes as a rotation about a respective center within the concave seat 57, the pusher 17 is retracted and the coil spring 24 consequently compressed further.

Concurrently with the movements of the gripper 28 described above, the arm 13 will be rotated by the electric motor 15 in a clockwise direction, as seen in FIG. 6, so as to move the blade 14 toward the concave seat 57 accommodating the tooth 56 of the latch element 46.

Figure 7:
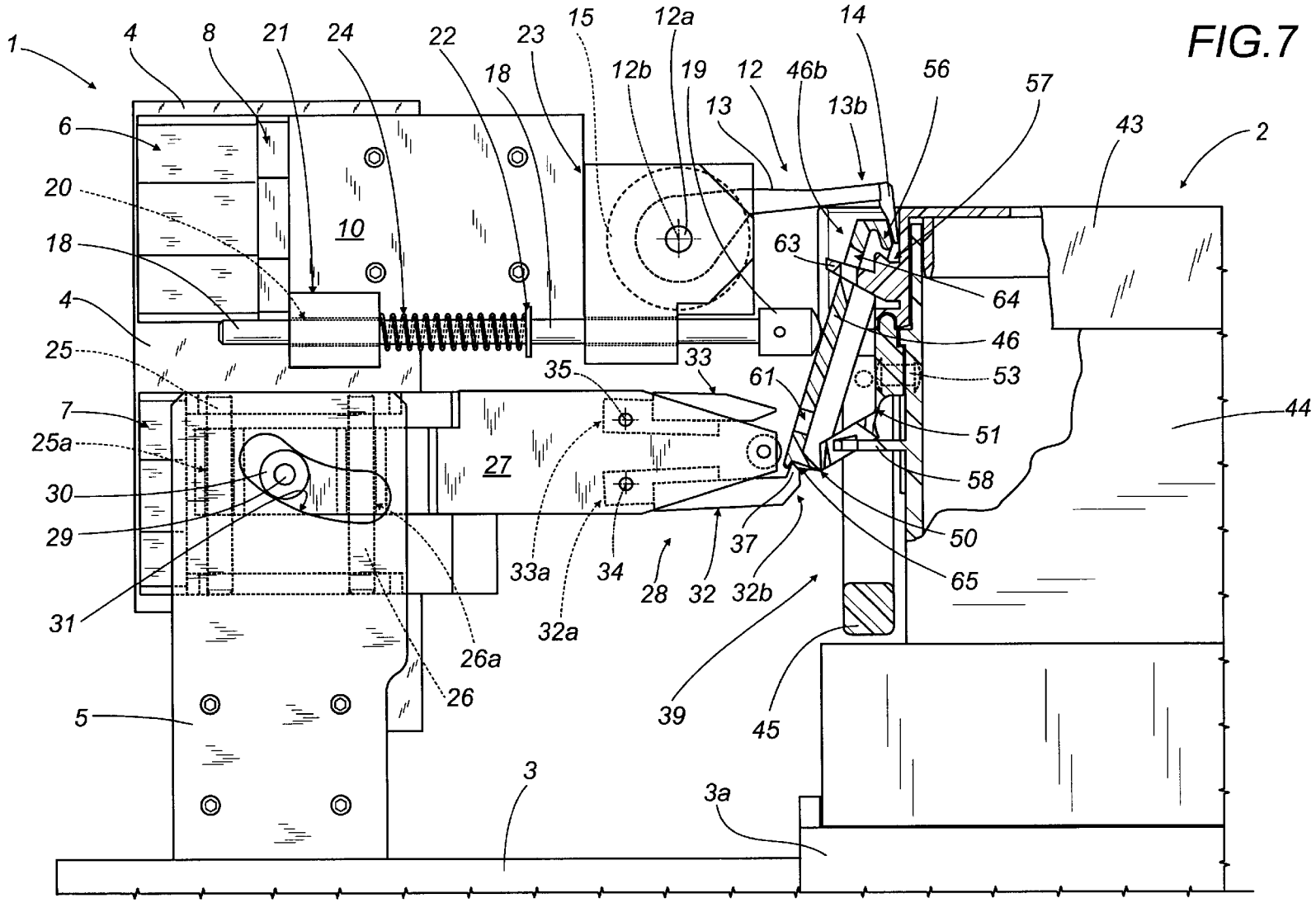

As illustrated in FIG. 7, the body 27 of the gripper 28 continues to be retracted, and lifted by the profile of the cam 31. This induces a further change in position of the latch element 46, still engaged by the lip 37 of the lower jaw 32, which occupies the relative recess 65. At the same time, the arm 13 continues to rotate clockwise, as viewed in FIG. 6, so that the blade 14 slips between the top end 46*b* of the latch element 46 and the portion of the front face 39 afforded by the lid 43.

As a result of the latch element 46 being lifted, the tooth 56 of the selfsame element 46 will become disengaged from the seat 57.

The flexible member 58 in its turn is completely withdrawn from the slot 61 of the latch element 46.

Figure 8:
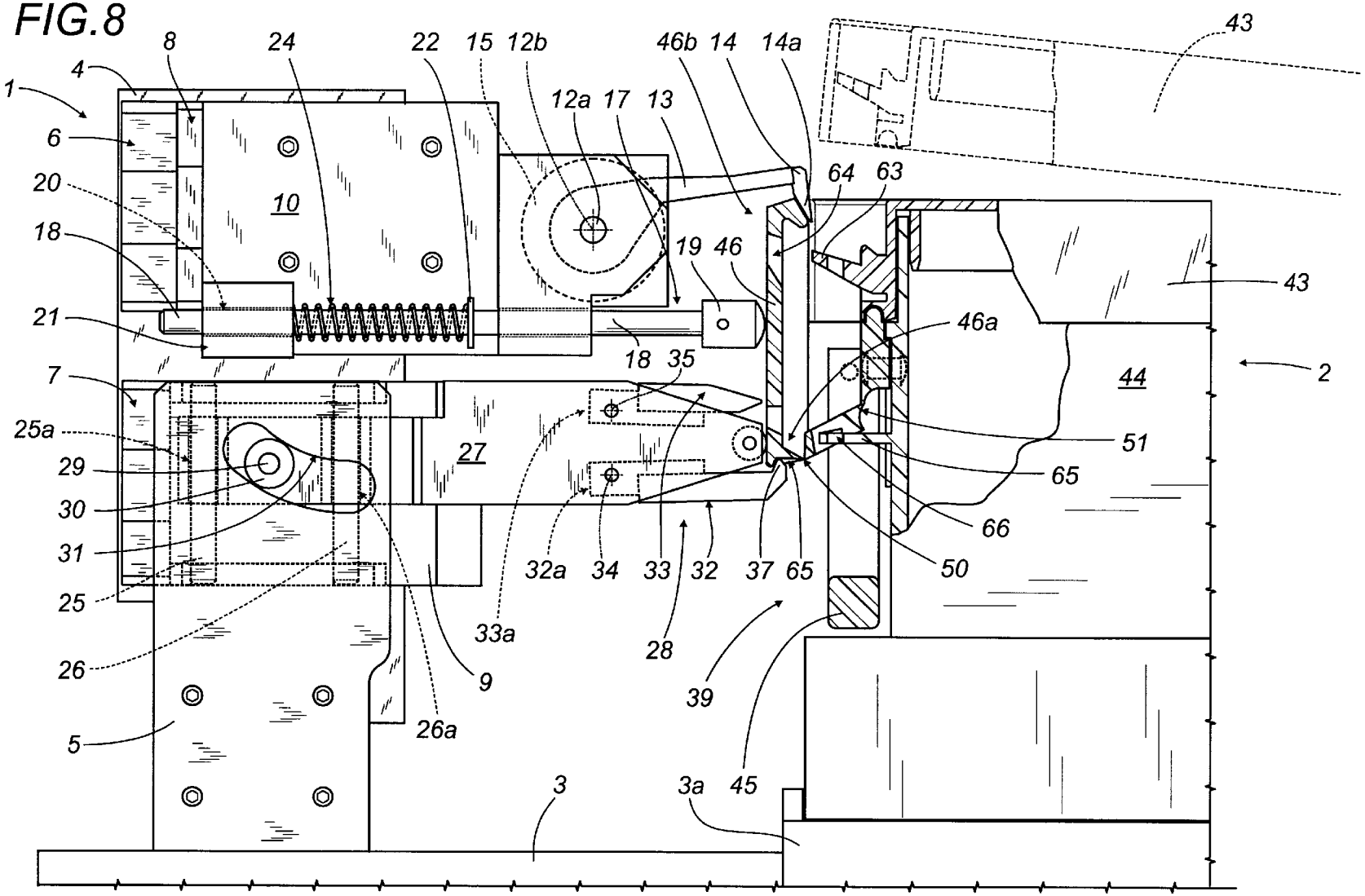

Referring next to FIG. 8, the top slide 8 is retracted along the relative way 6 and distanced from the box 2.

The arm 13 retracts as one with the slide 8 and the latch element 46 is drawn back by the blade 14, the one being maintained in contact with the other by the reaction force of the coil spring 24 acting on the pusher 17.

This further movement of the latch element 46 is substantially a rotation described about the line of contact between the lip 37 of the lower jaw 32 and the recess 65 afforded by the bottom end 46*a* of the latch element 46. The movement ceases as the latch element 46 assumes the substantially vertical position illustrated in FIG. 8.

In this position, the latch element 46 makes no contact with any part of the lid 43 and the lid 43 can therefore be raised, by manipulator means of conventional embodiment (not illustrated), thereby giving access to the inside of the container 44 of the box 2. An intermediate position in the opening movement of the lid 43 is illustrated by phantom lines in FIG. 8.

Thereafter, once the banknotes have been removed from or placed inside the container 44 the box 2 and the lid 43 has been replaced in its correct position covering the container 44, the device 1 proceeds to return the latch element 46 to its initial position, with the lid 43 secured on the container 44 as illustrated in FIG. 4.

The repositioning steps will be described briefly with reference to the same figures, being easily and clearly comprehensible.

Departing from the configuration assumed by the latch element 46 in FIG. 8, the top slide 8 moves along the relative way 6 toward the box 2, reaching a position in which the rotation of the arm 13 and consequently the disengagement of the blade 14 from the top end 46*b* of the element 46 will occasion an instantaneous clockwise rotation of the element 46, as viewed in FIG. 8, induced by the action of the spring 24 transmitted through the button 19, with the result that the top end 46*b* of the element 46 makes contact with the part of the front face 39 constituted by the lid 43 and the rigid member 63 is inserted through the corresponding slot 64. With the latch element 46 in this position, the bottom slide 9 begins moving along the way 7 toward the box 2, with the profile of the cam 31 again causing the body 27 of the gripper 28 to dip. During this same movement, the latch element 46 is maintained in contact with the lip 37 of the lower jaw 32 by the action of the spring 24 on the pusher 17. As a result of the contact, the latch element 46 dips together with the lower jaw 32 and the tooth 56 at the top end 46*b* is made to locate in the matching concave seat 57. As the slide 9 advances toward the box 2, the gripper jaws 32 and 33 are spread and, substantially in the same movement, the roller 36 will impinge on the outer surface 62 of the latch element 46, causing it to rotate about a fulcrum coinciding with the tooth 56, in a counterclockwise direction as viewed in FIG. 7.

With the latch element 46 driven toward the box 2 by the action of the slide 9 on the roller 36, the movement of the slide 9 ceases once the flexible member 58, deforming elastically during its passage through the relative slot 61, is fully inserted with the tooth 59 snapped over the corner edge 61*a* of the selfsame slot, establishing a stable locking position of the catch mechanism 68.

What is claimed is:

1. A device for operating the closure mechanism of a box containing groups of sheets, wherein the box comprises a container and a lid fastenable in a position by which the container is secured through the agency of a closure mechanism including at least one latch element by which a portion of the lid is connected to a retaining and locking element integral with the container and combining with the latch element to create a catch mechanism, wherein the device comprises:

means of releasing the latch element, by which the latch element is disengaged from the container and from the lid; and restraining means acting on the latch element in such a way as to distance the latch element from the lid, wherein the restraining means comprise an arm acting on the latch element in such a way as to engage the selfsame latch element.

2. The device as in claim 1, comprising a pusher acting on an outer surface of the latch element.

3. The device as in claim 2, wherein the pusher is spring-loaded and carried by a first slide having a direction of movement in a first direction transverse to the outer surface of the latch element.

4. The device as in claim 1, wherein the catch mechanism comprises:

a corner edge of an opening afforded by the latch element; and a protrusion afforded by a free end of a flexible member projecting freely from the container and designed to engage the corner edge, wherein the release means is embodied as a gripper comprising a body and a first and a second jaw.

5. The device as in claim 4, wherein the release means acts on the latch element, moving relative to the latch element according to a law of motion identifiable as a compound of a first and a second distinct movements, wherein the first distinct movement is a translation in a direction substantially parallel to the first direction and the second distinct movement is a translation in a direction perpendicular to the first direction.

6. The device as in claim 5, wherein the release means is carried by a second slide having a direction of movement in the first direction at least between a first limit position, at rest, and a second limit position in which the latch element is engaged by the release means when the box is secured by the closure mechanism.

7. The device as in claim 6, wherein the release means is carried by a third slide, carried in turn by the second slide, which has a direction of movement in a direction transverse to the first direction between a first limit position of engagement with the latch element when the box is secured by the closure mechanism, and a second raised position in which the latch element occupies a released position relative to the box.

8. The device as in claim 5, wherein the compound motion of the release means is determined by a profile of a cam engaged by a pivot rigidly associated with the third slide.

9. The device as in claim 4, wherein an upper second jaw acts on the flexible member, by which the latch element is retained and locked in a closure position, in such a manner as to free the latch element from the flexible member.

10. The device as in claim 4, wherein a lower first jaw acts on the latch element in such a way as to disengage the latch element from a portion of the lid.

11. The device as in claim 1, wherein the arm is carried by a first slide, wherein rotational movement of the arm in relation to the slide is about an axis transverse to the first direction and induced by respective actuator means, at least between a first at-rest limit position and a second limit position of engagement with the latch element.

12. The device as in claim 1, wherein the arm is furnished at one end with a head, appearing as a blade, destined to engage with the latch element.

13. The device as in claim 1, comprising means of fitting and securing the latch element, operating in conjunction one with another to bring about the stable engagement of the latch element.

14. The device as in claim 13, wherein the fitting and securing means comprise a roller positioned at one end of a third slide in such a way as to enter into contact with an outer surface of the latch element and bring about the closure of the catch mechanism.

* * * * *